US005664783A

United States Patent [19]

Harned

[11] Patent Number: 5,664,783

[45] Date of Patent: Sep. 9, 1997

[54] MAPLE-SEED SIMULATING AUTO-ROTATING TOY AND ASSOCIATED GAME

[76] Inventor: William D. Harned, 7537 Scenic View Dr., Knoxville, Tenn. 37938

[21] Appl. No.: 477,756

[22] Filed: Jun. 7, 1995

Related U.S. Application Data

[62] Division of Ser. No. 353,057, Dec. 9, 1994, Pat. No. 5,505,650.

[51] Int. Cl.[6] ..... A63B 67/00

[52] U.S. Cl. ..... 273/348

[58] Field of Search ..... 273/348, 428, 273/409, 347, 408; 446/34, 36–45

[56] References Cited

U.S. PATENT DOCUMENTS

| | | | |
|---|---|---|---|
| D. 84,029 | 4/1931 | Ditlevsen . | |
| 913,381 | 2/1909 | Hay . | |
| 1,110,738 | 9/1914 | Berecz . | |
| 3,573,869 | 4/1971 | Duckett | 273/409 X |
| 3,596,909 | 8/1971 | Russ | 273/409 X |
| 3,709,495 | 1/1973 | Krombein | 273/428 X |
| 3,715,121 | 2/1973 | Renn et al. | 273/428 X |
| 4,183,168 | 1/1980 | Ross | 46/60 |
| 4,299,394 | 11/1981 | Greenspan | 273/348 |
| 4,309,038 | 1/1982 | Spoon | 273/428 |
| 4,904,219 | 2/1990 | Cox | 446/36 |
| 5,173,069 | 12/1992 | Litos et al. | 446/36 |
| 5,284,454 | 2/1994 | Randolph | 446/45 |
| 5,286,033 | 2/1994 | Wayne | 273/428 X |

FOREIGN PATENT DOCUMENTS

| | | |
|---|---|---|
| 793980 | 2/1936 | France . |
| WO9009829 | 9/1990 | Germany . |
| 2093710 | 3/1982 | United Kingdom . |

*Primary Examiner*—Paul E. Shapiro
*Attorney, Agent, or Firm*—Pitts & Brittian

[57] ABSTRACT

A maple-seed simulating autorotating flyer. The flyer is provided with a spherical shock absorbing nose section and a wing section having a substantially straight leading edge, a curved tail, a spine conformed to said leading edge and tail and a curved trailing edge. The wing is constructed of a substantially planar sheet of a lightweight, semi-rigid fabric of uniform thickness. The weight of the nose, the length and width of the wing are configured so as to impart aerodynamic characteristics to the flyer such that when thrown upward, the flyer will autorotate during descent. The flyer is used in accordance with the method of the present invention, wherein the maple-seed simulating autorotator is thrown upward from a designated throwing area. A plurality of scoring targets, each having a designated point value, are randomly positioned around the throwing area. The thrower is awarded the number of points assigned to the scoring target that is hit by, or closest to, the autorotating flyer upon landing.

7 Claims, 3 Drawing Sheets

MAPLE-SEED SIMULATING AUTO-ROTATING TOY AND ASSOCIATED GAME

This application is a division of application Ser. No. 08/353,057 filed on Dec. 9, 1994, U.S. Pat. No. 5,505,650.

TECHNICAL FIELD

This invention relates to the field of hand-held, hand-launched flying toys. More specifically, it relates to a single-winged autorotator and an associated throwing game.

BACKGROUND ART

Many spinning, hand-launched, flying toys have been disclosed in the prior art. Typical of the art are those devices disclosed in the following United States and foreign patents:

| Patent No. | Inventor(s)/COUNTRY | Issue Date |
|---|---|---|
| Des. 84,029 | J. C. Ditlevsen | Apr. 28, 1931 |
| 913,381 | P. S. Hay | Feb. 23, 1909 |
| 1,110,738 | J. Berecz | Sept. 15, 1914 |
| 4,183,168 | R. E. Ross | Jan. 15, 1980 |
| 4,309,038 | D. M. Spoon | Jan. 5, 1982 |
| 4,904,219 | G. M. Cox | Feb. 27, 1990 |
| 5,173,069 | M. A. Litos, et al. | Dec. 22, 1992 |
| 5,284,454 | G. B. Randolph | Feb. 8, 1994 |
| 793,980 | FRANCE | Feb. 5, 1936 |
| 1,021,256 | FRANCE | Feb. 17, 1953 |
| 2,093,710A | UNITED KINGDOM | Sept. 8, 1982 |
| WO 90/09829 | PCT | Sept. 7, 1990 |

Of these patents, U.S. Pat. No. 1,110,738, issued to Berecz on Sep. 15, 1914, discloses a flying and spinning toy in the manner of a spinning top with an aerial propeller whereby the top first spins in a flying movement through the air and continues to spin on the ground upon landing.

U.S. Pat. No. Des. 84,029, issued to J. C. Ditlevsen on Apr. 28, 1931, discloses the ornamental design for a flying top.

U.S. Pat. No. 4,183,168, issued to Roger E. Ross on Jan. 15, 1980, discloses a flying disk toy having a crank for providing rotational acceleration.

U.S. Pat. No. 4,309,038, issued to Donald M. Spoon on Jan. 5, 1982, discloses a throw toy having spoke-like graspable members which extend from a central hub.

U.S. Pat. No. 4,904,219, issued to Glenn M. Cox on Feb. 27, 1990, discloses an autorotating hand flyer that is of a specific one piece construction. Cox's hand flyer has a tapered wing and a substantially pointed front end and an arcuate cut out on the root at the trailing edge of the flyer. Both the leading and trailing edge of Cox's flyer are substantially convex. Further, Cox's flyer has a pointed tail.

U.S. Pat. No. 5,173,069, issued to Mark A. Litos on Dec. 22, 1992, also discloses an autorotative flyer having a concave leading edge and a convex trailing edge which is provided with specifically configured scallops. Litos's wing, wing spar and root are integrally formed. Moreover, Litos teaches a specific tapering of the wing from leading to trailing edge. Further, Litos teaches that the thickness and rearward extension of the spar diminishes from the root to the wing tip. This specific tapering of both the wing and the spar results in increased manufacturing costs.

U.S. Pat. No. 5,284,454, issued to George B. Randolph on Feb. 8, 1994, discloses a toy helicopter which is capable of a projected nose up ascent and a helicopter nose down descent.

U.S. Pat. No. 913,381 issued to P.S. May on Feb. 23, 1909 discloses a toy having a rigid spine, a weight disposed at one end of the spine, and a membrane folded over and enclosing the spine. The toy is further provided with a plurality of branches extending from the spine.

Each of the foreign patents disclose further embodiments of auto-rotating flyers. Those disclosed in the French Patent ('980) and the PCT application ('829) are each provided with a wing member having a hollow, plastic sphere, disc, or box. In each embodiment disclosed in these patents, the sphere, disc, or box is fabricated from two cooperating halves which are secured to the wing. However, due to the fabrication of the individual halves, the sphere, disc or box is incapable of absorbing impact shock or for assisting in the stability of flight.

Accordingly, it is an object of this invention to provide an autorotating flyer toy that has a wing configuration that closely simulates the wing configuration of the autorotating maple seed.

It is a further object of this invention to provide an autorotating flyer that has a spherical nose.

Still another object of the present invention is to an autorotating flyer that has a spherical nose that is lightweight, yet has a shock absorbing capability to prevent damage or deformation of the nose upon impact.

Yet a further object of the present invention is to provide a novel game of toss to be played with the maple-seed simulating autorotating flyer.

Other objects and advantages over the prior art will become apparent to those skilled in the art upon reading the detailed description together with the drawings as described as follows.

DISCLOSURE OF THE INVENTION

In accordance with the various features of this invention, a maple-seed simulating autorotating flyer is provided. The flyer is provided with a spherical shock absorbing nose section and a wing section having a substantially straight leading edge, a curved tail, a spine conformed to said leading edge and tail and a curved trailing edge. The wing is constructed of a planar sheet of a lightweight, semi-rigid fabric of uniform thickness. The weight of the nose, the length and width of the wing are configured so as to impart aerodynamic characteristics to the flyer such that when thrown upward, the flyer will autorotate during descent.

A method of playing a novel game with the flyer is also provided. In accordance with the method of the present invention, the maple-seed simulating autorotator is thrown upward from a designated throwing area. A plurality of scoring targets, each having a designated point value, are randomly positioned around the throwing area. The thrower is awarded the number of points assigned to the scoring target that is hit by, or closest to, the autorotating flyer upon landing.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
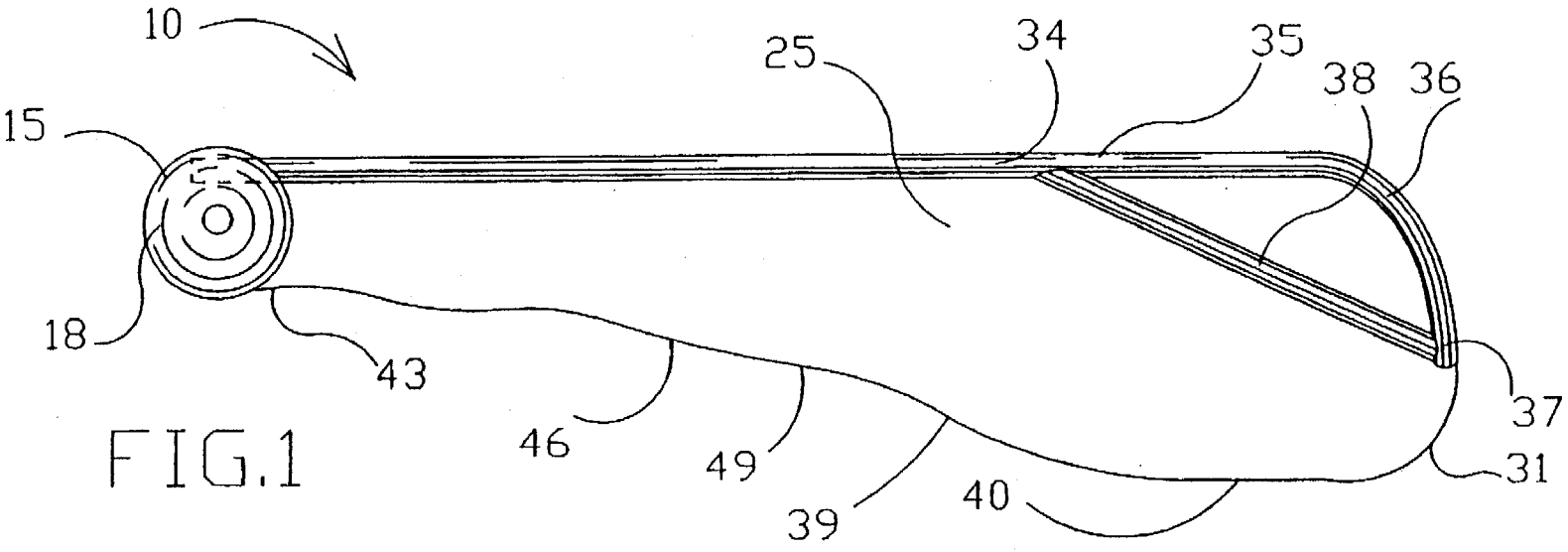
FIG. 1 illustrates a top plan view of the autorotator of the present invention.
Figure 2:
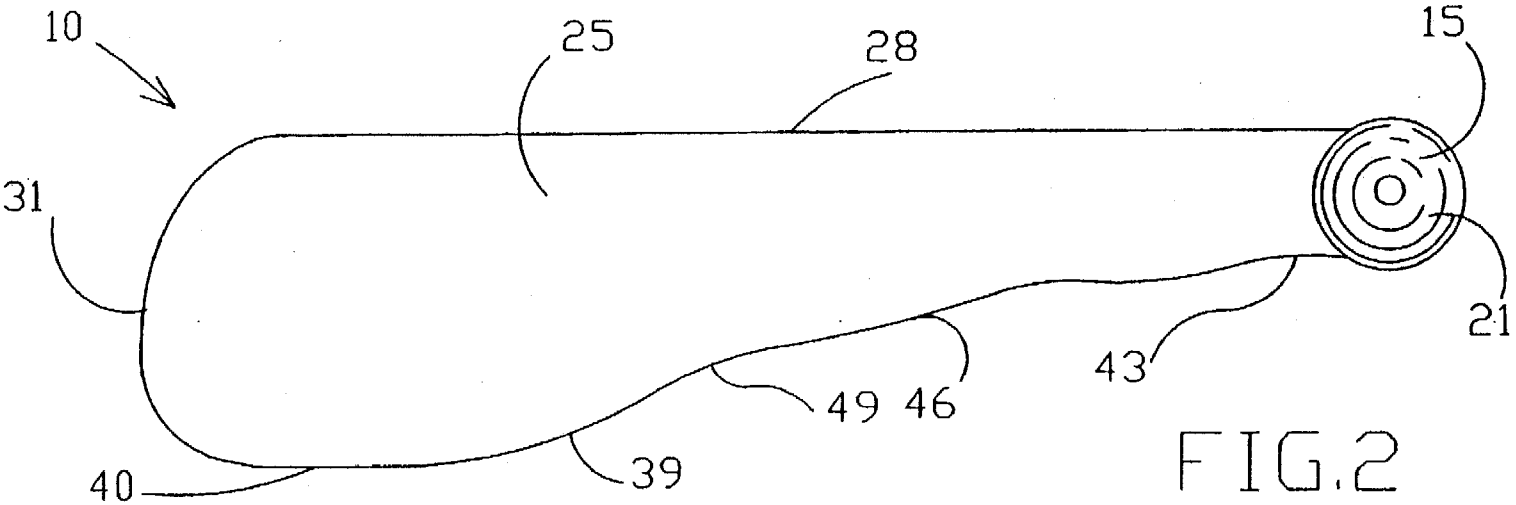
FIG. 2 illustrates a bottom plan view of the autorotator seen in FIG. 1.
Figure 3:
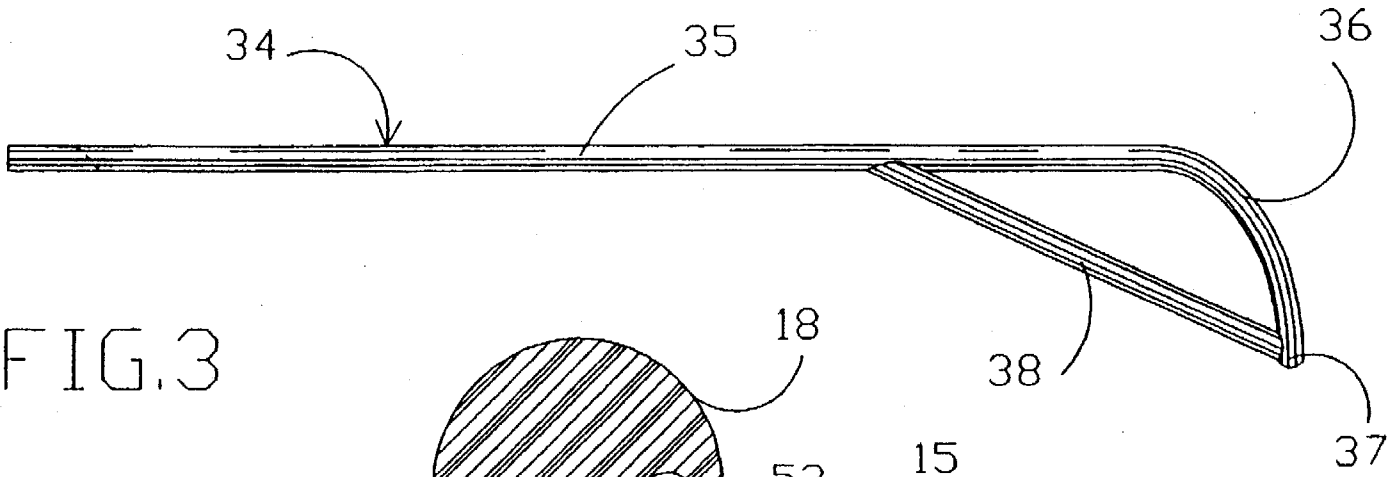
FIG. 3 illustrates a plan view of the wing brace of the autorotator of the present invention.
Figure 4:
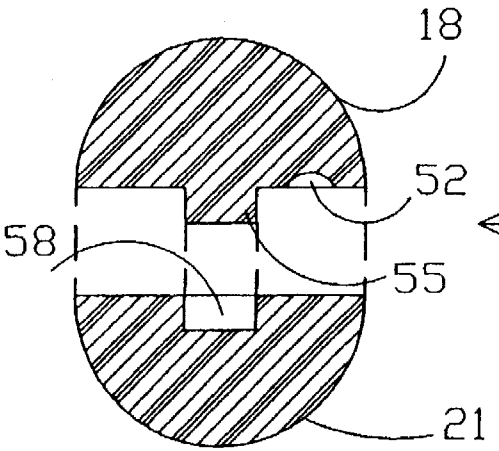
FIG. 4 illustrates a cross sectional view of the nose member of the autorotator of the present invention.
Figure 5:
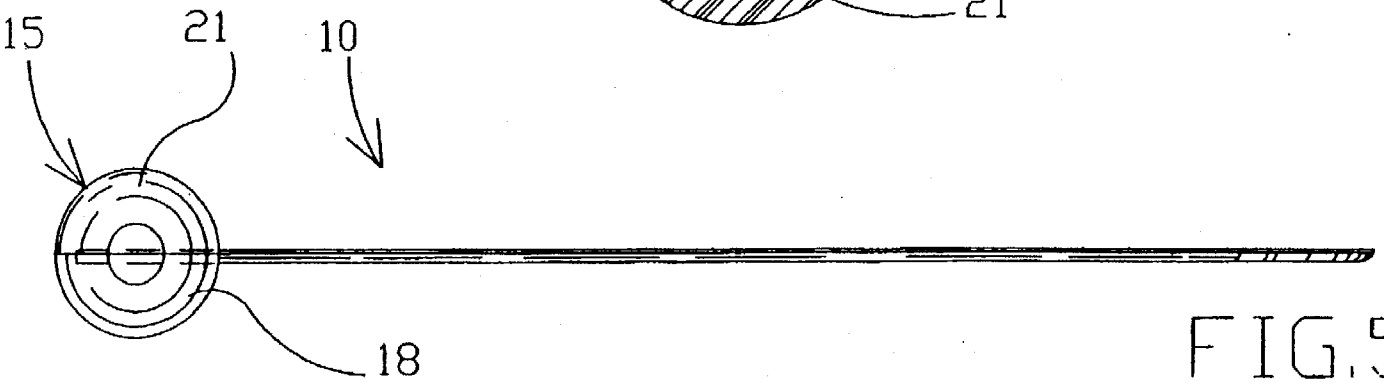
FIG. 5 illustrates a side view of the autorotator of the present invention.

A maple-seed simulating autorotating flyer, constructed in accordance with the present invention, is illustrated generally at 10 in the Figures. The autorotating flyer, or flyer 10, is comprised generally of a wing section 25 and nose section 15. The nose section 15 defines a substantially spherical configuration including an upper hemisphere 18 and a lower hemisphere 21. The nose section 15 is fabricated from a substantially resilient material that is shock absorbent such as, though not limited to, rubber.

The wing section 25 is comprised generally of a substantially planar member 16 and a spine 34. The planar member 26 defines a substantially straight leading edge 28, a curved tail 31, and a curved trailing edge 39. The trailing edge 39 defines a compound curve consisting of at least one substantially convex region 40 proximate the tail 31 and at least one substantially concave region 43 adjacent the convex region 40 along the trailing edge 39. In the preferred embodiment, a substantially convex region 46 is disposed between the concave region 43 and a second concave region 49. In the preferred embodiment, the convex region 40 defines the longest chord of the wing 25 while the concave region 43 defines the shortest chord of the wing 25. The wing 25 of the preferred embodiment is constructed of a substantially planar sheet of a lightweight material such as semi-rigid fabric or plastic having a uniform thickness.

The spine 34 is configured to conform to the leading edge 28 and tail 31 of the planar member 26. Specifically, the spine 34 defines a substantially straight segment 35 corresponding to and disposed along leading edge 28, and a curved segment 36 corresponding to and disposed along tail 31, the spine terminating at a distal end 37. In the embodiment illustrated in FIG. 1, a brace 38 is secured to the spine 34 at one end to a point along the straight segment 35 and at a further end to a point along the curved segment 36, proximate the distal end 37. In this embodiment, brace 38 and the curved segment 36 define a grasping member.

The proximal end of the wing 25 is disposed between the upper hemisphere 18 and the lower hemisphere 21 comprising the nose section 15. In the illustrated embodiment, the proximal end of spine 34 is received in a groove 52 defined by the upper hemisphere 18. The upper hemisphere 18 and the lower hemisphere 21 are secured one to the other in a conventional manner, such as with an adhesive, preferably an epoxy. In order to secure the relationship between the upper hemisphere 18 and the lower hemisphere 21, a locking tab 55 is disposed on the upper hemisphere 18, the locking tab 55 registering with and received by a notch 58 in the lower hemisphere 21. Of course, other conventional methods of securing wing 25 to the upper and lower hemispheres 18, 21 may be used as well. Therefore, it will be understood that the method disclosed herein is for illustration purposes only and is not intended to limit the present invention.

A method of playing a novel game with the maple-seed simulating autorotating flyer 10 is also provided. In accordance with the simplest embodiment of the method of the present invention, the flyer 10 is thrown upward from a designated throwing area 70. A plurality of scoring targets 75, each having a designated point value, preferably printed on the face of each scoring target 75, are randomly positioned around the throwing area 70. In the illustrated embodiment, twenty scoring targets 75 are provided with point designations as set out in the table below:

| Assigned Point Value | Number of Scoring Targets |
|---|---|
| 0 | 6 |
| 20 | 9 |
| 30 | 3 |
| 50 | 2 |

Figure 6:
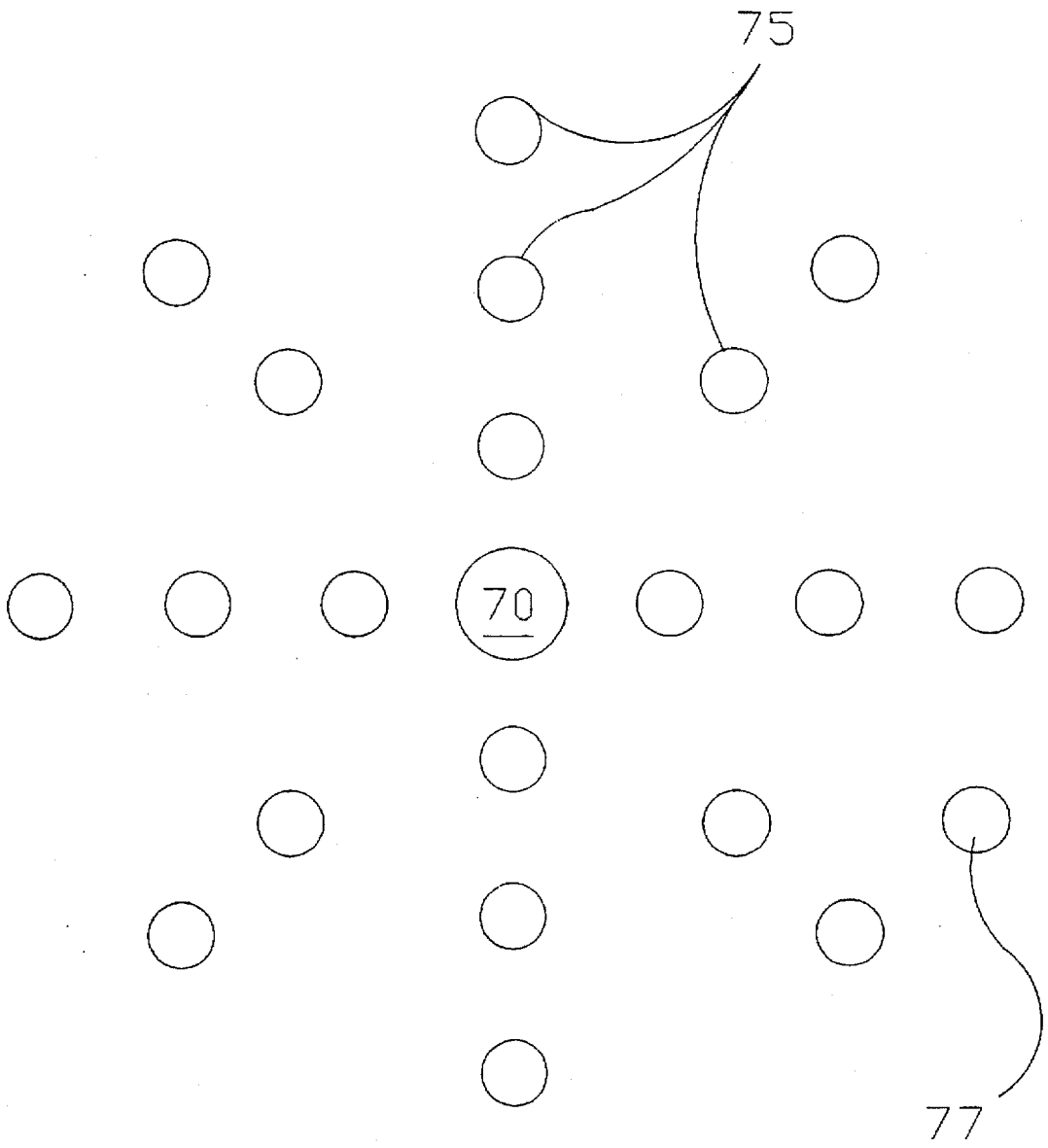
FIG. 6 illustrates a plan view of the preferred embodiment of the playing area for the disclosed method.

The thrower is awarded the number of points assigned to the scoring target 75 that is in closest proximity to, i.e. hit by, or closest to, the autorotating flyer 10 upon landing. In this fashion, a round of play between a plurality of players is commenced by shuffling the plurality, such as the twenty as set forth above, of scoring targets 75 and randomly placing scoring targets 75 face down, i.e. point side down, around the throwing area 70. The scoring targets 75 are spaced apart from each other and from the throwing area 70, as in the arrangement illustrated in FIG. 6.

The first player steps into throwing area 70 without disturbing the scoring targets 75. With the flyer 10 in hand, the player turns around within the throwing area 70 three to four times. The player then throws the flyer 10 upward without stepping on or out of the throwing area 70. If the player steps on or beyond the circumference of throwing area 70, the throw is disqualified and no points are awarded. Upon completion of a valid throw, the scoring target 75 that is hit by, or is closest to, the flyer 10 is turned over and the player is awarded the points assigned to the scoring target 75. This scoring target 75 is then removed from the playing field. A further bonus scoring target 77 can be provided which doubles a players points. In one method of play, the player with the most points when all of the scoring targets 75 are removed from the playing field is declared the winner. In an alternate method of play, the first player to be awarded one-hundred points is declared the winner. In still a further method of play, the player with the fewest points when one of the players reaches one-hundred points is declared the winner. In a method where a low score is desirable, the player may be penalized by the addition of a determined amount to his score if he steps out of the throwing area 70 during the throw.

From the foregoing description, it will be recognized by those skilled in the art that an autorotating flyer offering advantages over the prior art has been provided. Specifically, the autorotating flyer has a wing configuration that closely simulates the wing configuration of the autorotating maple-seed. Further, to prevent damage upon impact, the autorotating flyer has a spherical, shock absorbing nose. Yet further a novel game of toss to be played with the maple-seed simulating autorotating flyer is also provided.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A method of playing a game with an autorotating flying toy in which a player is awarded points, said game comprising the steps of:

randomly placing a plurality of scoring targets about a designated throwing area, each of said plurality of scoring targets having a designated point value printed upon a face thereof, throwing said autorotating flying toy upward from said designated throwing area such that said autorotating flying toy will descend to the ground proximate said plurality of scoring targets; and awarding the player said designated point value of one of said plurality of scoring targets in closest proximity to said autorotating flyer.

2. The method of claim 1 wherein a player is penalized if the player steps outside said throwing area.

3. The method of claim 1 after said step of awarding the player said designated point value, further comprising the step of alternating players to perform said step of throwing said autorotating flying toy and awarding the player said designated point value.

4. The method of claim 3 wherein a player wins by being the first of the players to score a total of points at least equal to a predetermined score.

5. The method of claim 1 wherein said autorotating flying toy comprises:

a substantially spherical nose member defining upper and lower hemispheres;

a wing member having a substantially straight leading edge, a curved tail, a curved trailing edge, and a proximal end disposed between said nose member upper hemisphere and said nose member lower hemisphere; and a spine carried by said wing member proximate said leading edge, said spine being conformed to said leading edge and said curved tail, said spine having a substantially straight segment disposed along said leading edge, a curved segment disposed along said tail, a distal end, and a proximal end terminating proximate said nose member.

6. The method of claim 5 wherein said autorotating flying toy further comprises a brace defining a fast secured to said spine proximate said substantially straight segment and a second end secured to said spine proximate said distal end, thereby providing a grasping member.

7. The method of claim 6 wherein said spherical nose member upper hemisphere defines a groove for closely receiving said proximal end of said spine.

* * * * *